US007139503B2

(12) United States Patent
Mizusawa

(10) Patent No.: US 7,139,503 B2
(45) Date of Patent: Nov. 21, 2006

(54) CLEANING APPARATUS WITH CONDUCTIVE MEMBER

(75) Inventor: Hiroshi Mizusawa, Tokyo (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 10/686,646

(22) Filed: Oct. 17, 2003

(65) Prior Publication Data

US 2004/0131405 A1 Jul. 8, 2004

(30) Foreign Application Priority Data

Oct. 19, 2002 (JP) ..... 2002-303386

(51) Int. Cl.
*G03G 15/02* (2006.01)
*G03G 21/00* (2006.01)

(52) U.S. Cl. ..... 399/100; 399/353; 430/125

(58) Field of Classification Search ..... 399/100, 399/99, 101, 353, 129, 343, 175, 149, 150; 15/1.51, 256.5, 256.51, 256.52; 430/125
See application file for complete search history.

(56) References Cited

U.S. PATENT DOCUMENTS

| | | | | |
|---|---|---|---|---|
| 4,361,922 | A * | 12/1982 | Karal | 15/1.51 |
| 4,956,677 | A * | 9/1990 | Akiyama | 399/353 X |
| 5,233,394 | A * | 8/1993 | Fujita et al. | 399/101 |
| 5,371,578 | A * | 12/1994 | Asano et al. | 399/100 |
| 5,722,015 | A * | 2/1998 | Tombs | 399/129 |
| 6,070,043 | A * | 5/2000 | Fujita et al. | 399/313 |
| 6,085,062 | A | 7/2000 | Mizuishi et al. | 399/358 |
| 6,128,449 | A | 10/2000 | Zenba et al. | 399/50 |
| 6,144,811 | A | 11/2000 | Ohori et al. | 399/9 |
| 6,144,822 | A | 11/2000 | Yamaguchi et al. | 399/121 |
| 6,148,161 | A | 11/2000 | Usui et al. | 399/58 |
| 6,160,969 | A | 12/2000 | Ishigaki et al. | 399/49 |
| 6,175,711 | B1 * | 1/2001 | Yoshino et al. | 399/297 |
| 6,266,501 | B1 | 7/2001 | Mizuishi et al. | 399/106 |
| 6,311,031 | B1 * | 10/2001 | Hirano | 399/101 |
| 6,430,379 | B1 * | 8/2002 | Takahashi et al. | 399/101 X |
| 6,442,367 | B1 | 8/2002 | Itami et al. | 399/349 |
| 6,628,903 | B1 | 9/2003 | Ohori et al. | 399/21 |
| 2002/0106212 | A1 * | 8/2002 | Amemlya et al. | 399/100 |
| 2003/0035657 | A1 * | 2/2003 | Asano et al. | 399/53 |
| 2003/0044196 | A1 * | 3/2003 | Amemlya et al. | 399/100 |

FOREIGN PATENT DOCUMENTS

| | | |
|---|---|---|
| EP | 0 327 227 | 8/1989 |
| EP | 0 738 938 | 10/1996 |
| EP | 1 229 399 A1 * | 8/2002 |
| JP | 6-95570 | 4/1994 |
| JP | 7-140763 | 6/1995 |
| JP | 7-210026 | 8/1995 |
| JP | 8-22173 | 1/1996 |
| JP | 2002-221883 | 8/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A cleaning apparatus includes a brush member to be brought into contact with a member to be cleaned to remove toner particles attached to the member. The brush member includes a conductive material.

27 Claims, 4 Drawing Sheets

FIG. 4

| | FRONT SIDE OF IMAGE | CENTER OF IMAGE | BACK SIDE OF IMAGE |
|---|---|---|---|
| NON-CONDUCTIVE BRUSH | 1.05 | 1.03 | 1.55 |
| CONDUCTIVE BRUSH | 0.47 | 0.79 | 0.61 |

(CONTAMINATION ID ON CHARGING ROLLER AFTER PASSAGE OF 45000 PAPERS)

CLEANING APPARATUS WITH CONDUCTIVE MEMBER

CROSS REFERENCE TO RELATED APPLICATIONS

This application claims priority to Japanese patent application no. 2002-303386, filed on Oct. 17, 2002, the disclosure of which is incorporated by reference herein in its entirety.

BACKGROUND OF THE INVENTION

1. Field of the Invention

The present invention relates to a cleaning apparatus for removing dirt attached to a member included in image forming apparatuses such as copiers, facsimiles and printers, and more particularly to the cleaning apparatus including an electrically conductive brush attached to a brush roller for removing residual toner particles.

2. Discussion of the Background

In known image forming apparatuses such as copiers, printers and facsimiles, for example, a toner image is carried in the form of a sheet on a recording media, having been formed by an image forming mechanism such as electrophotography, for example. The toner image which is carried on the recording medium is formed on an image bearing body, such as photoreceptor, for example, before being transferred to the recording medium.

In an image forming apparatus, for example, an electrophotographic image forming apparatus, the peripheral surface of a cylindrical electrophotographic photoreceptor, i.e., photoconductive drum as an image bearing member, is uniformly charged, and an electrostatic latent image is formed on the uniformly charged peripheral surface in accordance with image formation data. This electrostatic latent image is visualized with the use of developer, that is, a toner image is formed. Then, the toner image is transferred from the photoreceptor onto a piece of transfer medium, i.e., recording medium, and is fixed to the transfer medium, to obtain a copy or a print.

Up to now, a cleaning apparatus has been utilized in an image forming process of a toner image in order to clean the peripheral surface of the image bearing body, a charging roller and a transfer belt which form a toner image onto a recording medium. The cleaning apparatus removes residual toner particles attached to the cleaning target and dirt such as paper dust.

In unexamined Japanese Laid-Open Patent Application Publications No. 6-095570 and 7-140763, a cleaning apparatus is known to include a brush roller which is placed in contact with the peripheral surface of the target for cleaning. In the cleaning apparatus of this kind, the brush roller is rotated by a driving apparatus. Difference between the linear velocity of a brush brought into contact with the peripheral surface of a cleaning object and the linear velocity of the cleaning target causes residual foreign substance to be swept away, cleaning the peripheral surface of photoreceptor.

In unexamined Japanese Laid-Open Patent Application Publication No. 2002-221883, a brush with a bristle of approximately 2 mm or less in length is proposed. However, the foreign substance is cleaned not by a difference of linear velocity between a brush roller and the cleaning target but by using elastic deformation to hold one edge of the bristle in contact with the peripheral surface of a cleaning target.

However, when foreign substances such as toner and paper dust, for example, are strongly adhered to the cleaning target, the foreign substances are not removed by the above-described removing mechanisms. If the foreign substances continue to accumulate, a blurred line may be printed during operation of the image forming apparatus.

SUMMARY OF THE INVENTION

In view of the forgoing, it is an object of the present invention to provide a novel cleaning apparatus for removing dirt attached to a member included in a variety of image forming apparatuses such as copiers, facsimiles and printers, and more preferably to provide an electrically conductive brush attached to a brush roller for removing residual toner particles.

Another object of the present invention is to provide a novel image forming apparatus for removing dirt attached to a member included in a variety of image forming apparatuses such as copiers, facsimiles and printers, and more preferably to provide an electrically conductive brush attached to a brush roller for removing residual toner particles.

To achieve the above-mentioned objects and others, a cleaning apparatus includes a brush member to be brought into contact with a member to be cleaned to remove toner particles attached to the member, and the brush member includes a conductive material.

In the cleaning apparatus, the brush member may be held by its own weight in contact with the member to be cleaned.

The brush member may be driven to rotate by rotation of the member to be cleaned.

A length of the brush member may be approximately 2 mm or less.

The brush member may include a plurality of brush bristles including the conductive material, and each of the brush bristles may have a thickness of approximately 5 deniers or less, and the brush member may have a density of approximately 15000 bristles/$cm^2$ or more.

The brush member and the toner particles may be oppositely charged to each other.

A resistance value of the brush member may be in a range of from approximately $1\times10^3$ Ω to approximately $1\times10^8$ Ω.

The brush member may include a brush roller. The conductive material may include carbon. The member to be cleaned may include a charging device, an image bearing body, and/or a transfer device.

To achieve these and other objects, a novel image forming apparatus includes a cleaning apparatus which can include a brush member to be brought into contact with a member to be cleaned to remove toner particles attached to the member, and the brush member may include a conductive material.

In the image forming apparatus, the brush member may be held by its own weight in contact with the member to be cleaned.

The brush member may be driven to rotate by rotation of the member to be cleaned.

A length of the brush member may be approximately 2 mm or less.

The brush member may include a plurality of brush bristles including the conductive material, and each of the brush bristles may have a thickness of approximately 5 deniers or less, and the brush member may have a density of approximately 15000 bristles/$cm^2$ or greater.

The brush member and the toner particles may be oppositely charged to each other.

A resistance value of the brush member may be in a range of from approximately $1\times10^3$ Ω to approximately $1\times10^8$ Ω.

The brush member may include a brush roller. The conductive material may include carbon.

The image forming apparatus can include an image bearing body to bear an image on the image bearing body, and a charging device to charge the image bearing body, and the member to be cleaned may include the image bearing body, and/or the charging device.

The image forming apparatus may further include a transfer device to transfer the image on the image bearing body to a recording medium, and the member to be cleaned may include the transfer device.

In the image forming apparatus, the toner particles may be prepared by a polymerization method.

The image forming apparatus may further include a process cartridge including at least the cleaning apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 4 is a table showing a degree of contamination comparing the first example where the brush is conductive with the second example where the brush is non-conductive as a function of a number of sheets having been passed.

DETAILED DESCRIPTION OF PREFERRED EMBODIMENTS

Figure 1:
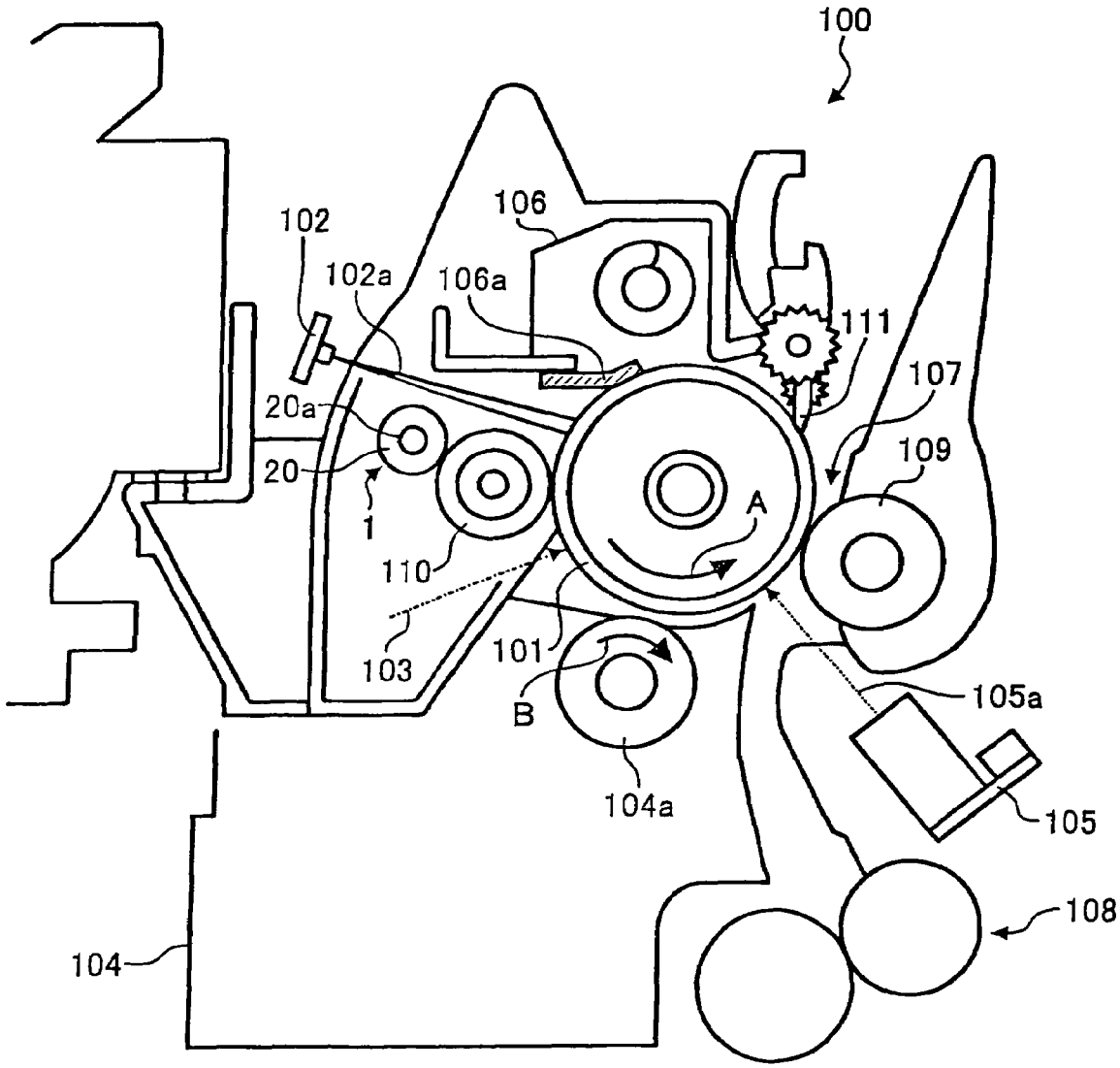
FIG. 1 is a side view illustrating an image forming apparatus which includes a cleaning apparatus according to a preferred embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, FIG. 1 shows an image forming apparatus 100 according to a preferred embodiment of the present invention.

FIG. 1 shows a side view of the image forming apparatus 100 which performs an image forming operation. The image forming apparatus 100 may include a copier, a facsimile and a printer. In this embodiment, a printer is an exemplary apparatus which will be explained later. The image forming apparatus 100 forms a monochrome and a color image in the image forming operation.

Any recording sheet may be used for the image forming operation as a recording medium for the image forming apparatus 100, including plain papers generally used for copying, so-called 90-kilogram sheets (such as overhead projector (OHP) sheets), cards and envelopes, for example, or a cardboard with a basis rate of substantially equal to or more of 100 g/m$^2$ and also including specific sheets with greater heat capacity than plain papers such as envelopes, for example.

In FIG. 1, the image forming apparatus 100 can include a first cleaning apparatus 1, a photosensitive drum (hereinafter referred to as photoreceptor) 101, a discharging apparatus 102, a discharging beam 102*a*, a laser beam 103, a developing apparatus 104, a developing roller 104*a*, a discharging apparatus 105, a discharging beam 105*a*, a second cleaning apparatus 106, a blade 106*a*, a transfer region 107, a registration 108, a transfer charger 109, a charging roller 110, a separation nail 111, a brush roller 20, and/or an axis 20*a*.

The photoreceptor 101 is photoconductive in its nature, and the peripheral surface of the photoreceptor 101 is coated with organic photosensitive substance. The photoreceptor 101 rotates counter-clockwise in a direction of an arrow A, and acts as a cylindrical image bearing body. The charging roller 110 uniformly charges the photoreceptor 101 and an exposure apparatus (not shown) scans the photoreceptor 101 with light by emitting the laser beam 103 and forms an electrostatic latent image according to image information read into a system through an external apparatus or the like on the photoreceptor 101 after the photoreceptor 101 is charged by the charging roller 110.

The developing apparatus 104 develops an electrostatic latent image on the photoreceptor 101 after the photoreceptor 101 is exposed to the light beam. The discharging apparatus 105 discharges the photoreceptor 101 by emitting the discharging beam 105*a* after an original image is developed. The transfer apparatus 109 electrostatically transfers on a recording sheet (not shown) a toner image formed on the photoreceptor 101 from the developing apparatus 104. A feeding tray (not shown) has sheets piled on it and a feeding roller (not shown) feeds sheets piled on the tray to the registration 108. The above-mentioned recording sheet (not shown) is a transfer member and serves as a sheet recording medium held in contact with the photoreceptor 101. The registration 108 transfers the recording sheet in a predetermined timing to the photoreceptor 101 and the transfer charger 107, and the recording sheet passes through between the photoreceptor 101 and the transfer direction switching 109. The separation nail 111 separates the recording sheets from the photoreceptor 101 after the image is recorded onto the recording sheet. The second cleaning apparatus 106 removes residual particles of toner that remain on the photoreceptor 101 from the photoreceptor 101 after image transfer process. The discharging apparatus 102 discharges the photoreceptor 101 by emitting the discharging beam 102*a* to the photoreceptor 101 before recharging the photoreceptor 101 using the charging roller 110. The charging roller 110 evenly charges the surface of the photoreceptor 101 again to prepare the next image forming operation. The recording sheet separated by the separation nail 111 is forwarded to a fixing apparatus, (not shown). The fixing apparatus (not shown) fixes a toner image transferred from the transfer apparatus 109 to the photoreceptor 101 on the recording sheet. After an image is fixed, the recording sheet is ejected out of the image forming apparatus 100.

The developing roller 104*a* that is included in the developing apparatus 104 makes contact with the photoreceptor 101 and rotates in the same direction with the photoreceptor 101, that is, the developing roller 104*a* is rotated clockwise in a direction of an arrow mark B, while the photoreceptor 101 is rotated counter-clockwise in the direction of the arrow A.

The second cleaning apparatus 106 removes particles of residual toner adhered to the photoreceptor 101 and foreign substance such as paper dust, for example. The transfer charger 109 may be in the form of a transfer belt which serves as a transfer device. The toner which is used in the image forming operation performed by the image forming apparatus 100, that is, by the developing apparatus 104, can be prepared by a polymerization method.

Figure 2:
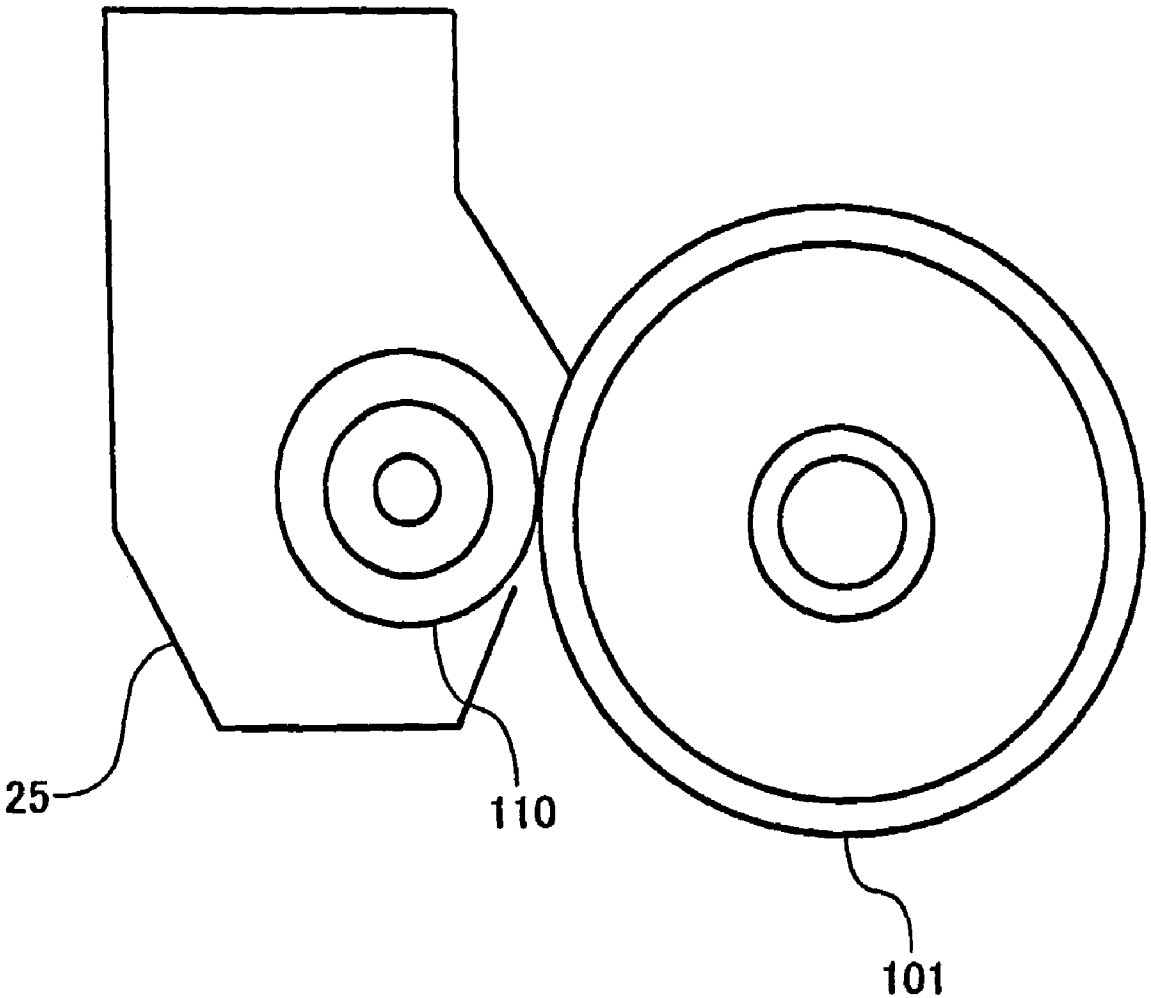
FIG. 2 is a side view illustrating a process cartridge.

The first cleaning apparatus 1 includes the brush roller 20. The brush roller 20 is brought into contact with the charging roller 110 which serves as the charging device. The brush roller 20 has a plurality of bristles (not shown) on its peripheral surface. The brush roller 20 and the charging roller 110 are supported rotationally against the main assembly of the process cartridge (FIG. 2). The brush roller 20 is supported by a bearing (not shown) which is integrated with the main assembly of the process cartridge.

The bearing supports the brush roller 20 and the axis 20*a* which are attached slidably and rotationally. The bearing has a slit (not shown) with the length parallel to the contact/separate direction. The bearing allows the brush roller 20 to be brought into contact by its weight with the charging roller 110 (i.e., the brush roller 20 is brought into contact with and rests against the charging roller 110). The brush roller 20 is made to rotate in synchronism with the rotation of the charging roller 110.

Referring now to FIG. 2, a process cartridge 25 can include at least the first cleaning apparatus 1. In this embodiment, the first cleaning apparatus 1 is an apparatus which forms the process cartridge 25 with the charging apparatus 110 and the photoreceptor 101. The first cleaning apparatus 1 cleans the charging roller 110. The photoreceptor 101 is driven in rotation in the direction of the arrow A by a driving source (not shown) and the charging roller 110 is made to rotate by its weight driven by the rotation of the photoreceptor 101. The brush roller 20 is made to rotate by its weight driven by the charging roller 110.

Because the brush roller 20 rests against the charging roller 110, a member to restrict a pressing pressure of the brush roller 20 against the charging roller 110 is unnecessary and the structure of the cleaning apparatus can be simplified, thereby reducing cost.

More specifically, because a length of bristles of the brush are approximately 2 mm or less, a bending moment can be reduced, which acts on the base edge of the bristles elastically deformed and bent after pressing strongly against the peripheral surface of the charging-roller 110. Therefore, the bristles are prevented from being broken, and a permanent or plastic deformation can be prevented, and the life of the brush roller 20 is increased.

Accordingly, with respect to the thickness and density of brush bristles, the thickness of the bristles is preferably set as approximately 5 deniers or less and the density of bristles is preferably approximately 15000 bristles/$cm^2$ or more.

Therefore, a greater number of bristles are held in contact with the peripheral surface of the charging roller 110 and the load that each of the bristles bears is reduced to prevent the bristles from breaking. Because the density of bristles is high, there are an increased number of bristles that are held in contact with the peripheral surface of the charging roller 110. The brush with many bristles may be held in contact with and satisfactorily clean the peripheral surface of the charging roller 110. Brushes and toner are electrically charged and opposite in polarity. In one example, when the polarity of toner is negative, a member with positive charging series such as nylon, for example, is used as a brush member. This increases adhesion of toner to the brush, enhancing the removing power of toner from the charging roller 110. Preferably a resistance value of the brush is in a range of from approximately $1\times10^3$ Ω to approximately $1\times10^8$ Ω, for example, and abnormal images caused by an application of an insufficient of pressure which is applied to the charging roller 110 are prevented from being formed.

Figure 3:
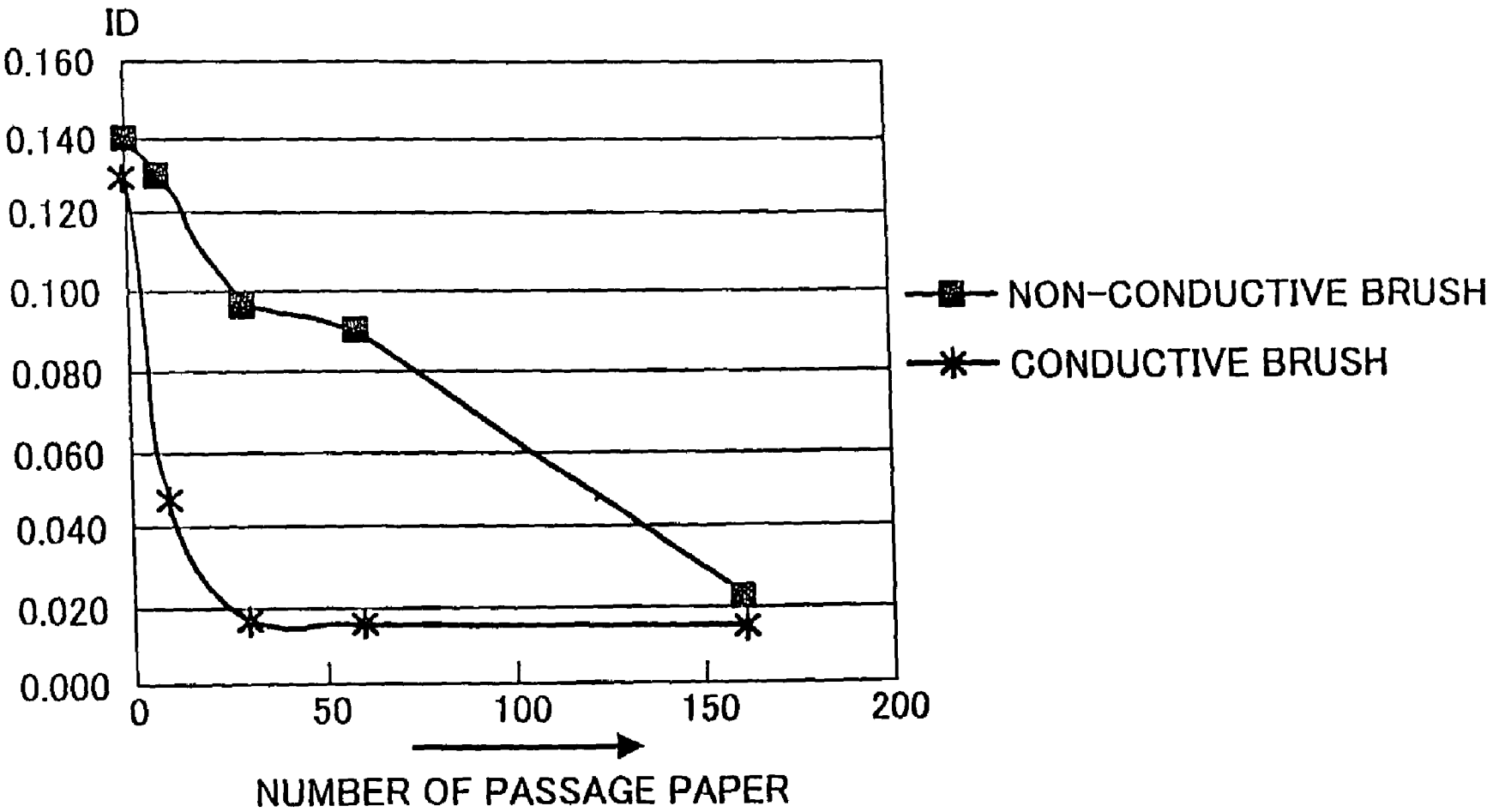
FIG. 3 is a chart comparatively illustrating a degree of contamination of a first example where a brush is conductive and a second example where a brush is non-conductive as a function of a number of sheets having been passed.

Referring now to FIG. 3, a chart is shown for an evaluation test performed with regard to cleaning capacity between a first example in which a conductive member is used as the brush roller 20 and a second example in which a non-conductive member is used as a brush roller to clean toner particles adhesive to the charging roller 110. The evaluation test was performed such that after removing the brush roller 20 from the main body, the peripheral surface of the charging roller 110 was intentionally contaminated with particles of toner. Brush rollers 20 with conductive and non-conductive members were sequentially applied. The density of the toner particles attached to the brushing members was calculated for varying numbers of passed sheets. Carbon-separated nylon was used as a conductive member of the brush roller 20 and nylon was used as a non-conductive member of the brush roller 20.

As shown in FIG. 3, when a number of papers passed is approximately 50, an image density (ID) is approximately 0.095 for the brush roller 20 with the conductive member and as the number of passed sheets increases. The chart shows a steep downward slope in terms of the ID when the brush roller 20 with a conductive member is used.

Therefore, the brush roller 20 with the conductive member can remove more toner particles attached to the charging roller 110 after the passage of a smaller number of sheets as compared to the brush roller 20 with the non-conductive member. That is, more toner particles can be removed from a cleaning target when the member of the brush roller 20 is conductive.

Referring to FIG. 4, a table 1 to show two cases of cleaning will be explained.

The brush roller 20 with the conductive member and the brush roller with the non-conductive member produce stable result in terms of removing particles of toner attached to the charging roller 110. The evaluation results were conducted in an identical manner to the evaluation of the FIG. 3.

The member of the brush roller 20 with the conductive member and the member of the brush roller with the non-conductive member are substantially identical to the brush rollers 20 of FIG. 3, respectively. FIG. 4 shows a result of the contamination of the charging roller 110 after passage of 45000 sheets.

As shown in the table of FIG. 4, in the case of using the brush roller 20 with the conductive member, the ID is 0.79 in the center of the image of a sheet, for example.

FIG. 4 shows that the conductive brush roller 20 can remove particles of toner on the charging roller 110 in more stable fashion, and the brush roller 20 may be used for a longer time than the non-conductive brush roller.

In the preferred embodiment of the present invention with the above-described structure, an image forming begins by a predetermined operation and the photoreceptor 101 is driven to rotate in the direction of the arrow A. During the time the photoreceptor 101 rotates, it undergoes various kinds of separate stages including the charging process performed by the charging roller 110, the exposure process by the laser beam 103, the developing process by the developing apparatus 104, the transfer process by the transfer apparatus 109 and the cleaning process by the second cleaning apparatus 106. After the photoreceptor 101 undergoes the discharging process performed by the discharging apparatus 102, the photoreceptor 101 repeats the next image forming step in which the photoreceptor 101 is charged again by the charging roller 110.

Meanwhile, it is noted that residual particles of toner attached to the photoreceptor 101 after transferring a toner image to a transfer recording medium are mostly removed by the second cleaning apparatus 106.

However, a trace quantity of toner particles cannot be removed by the second cleaning apparatus 106. The toner particles pass through the blade 106*a*. The particles of toner that have passed through the blade 106*a* are adhered to the charging roller 110. However, the particles of toner on the charging roller 110 are removed by the brush roller 20 driven for rotation by the charging roller 110.

Paper dust is adhered to the photoreceptor 101 from the paper that is held in contact with the photoreceptor 101 in the transfer region 107 during the image transfer process. Likewise, the paper dust adhered to the photoreceptor 101 is not wholly removed by the second cleaning apparatus 106 but is adhered to the charging roller 110 and accumulated thereon. In the same manner mentioned above, the paper dust that has adhered to the charging roller 110 in the above-described manner is removed by the brush roller 20. As above-described, foreign substances such as toner and paper dust, for example, are further removed because cleaning performance of the brush roller 20 is enhanced. Therefore, removing performance will be maintained for a relatively long time.

As mentioned, toner can be prepared by a polymerization method. Because charge counter mass ratio for each of the particles is uniform for every particle, transfer efficiency is enhanced in a transfer process performed statically. The amount of toner residing on the photoreceptor 101 is less than the amount of toner which is manufactured by other methods.

Hence, using the toner made by the polymerization method prevents dirt from adhering to the peripheral surface of the charging roller 110. The stranger the form of toner is, the more efficient the removal efficiency by the second cleaning apparatus 106 is in comparison with when the form of the toner is like a pearl. Therefore, it is also effective to remove dirt that the toner is made such that the form of the toner is strange in terms of form, unable to keep the charging roller 110 clean with the passage of time.

A cleaning apparatus and an image forming apparatus have been explained. Preferably, other members can also be used. In one example, a photoreceptor may be cleaned. When the photoreceptor includes the transfer apparatus such as the transfer apparatus 109 and transfer belt (not shown), the photoreceptor can be cleaned. At least one of the charging rollers 110, the life span which is extended by the first cleaning apparatus 1 to a great extent, as well as the first cleaning apparatus 1 itself may be included in this embodiment. By fully using the first cleaning apparatus 1 and the charging roller 110, the process cartridge can be used longer as an assembly and unmatched convenience of operation is made the most of, though the first cleaning apparatus 1 does not necessarily include the process cartridge.

Numerous additional modifications and variations are possible in light of the above teachings. It is therefore to be understood that within the scope of the appended claims, the disclosure of this patent specification may be practiced otherwise than as specifically described herein.

What is claimed is:

1. A cleaning apparatus, comprising:

a brush member configured to contact and to remove negatively charged toner particles from a charging roller that is electrically charged, wherein the brush member comprises a conductive material and a fiber material that is positively chargeable when rubbed with the toner particles, wherein the brush member is configured to be driven to rotate by rotation of the member, and wherein the brush member has a resistance value between $1\times10^3$ Ω and $1\times10^8$ Ω.

2. The cleaning apparatus according to claim 1, wherein the brush member is configured to be held by its own weight in contact with the member.

3. The cleaning apparatus according to claim 1, wherein the brush member comprises a plurality of bristles, and a length of the bristles is not greater than 2 mm.

4. The cleaning apparatus according to claim 1, wherein the brush member comprises a plurality of bristles including the conductive material, wherein the bristles have a thickness of not greater than 5 deniers, and wherein a density of the bristles is at least 15000 bristles/cm$^2$.

5. The cleaning apparatus according to claim 1, wherein the brush member comprises a brush roller.

6. The cleaning apparatus according to claim 1, wherein the conductive material comprises carbon.

7. The cleaning apparatus according to claim 1, wherein the charging roller comprises a charging device contacting the brush member, the brush member configured to clean the charging device.

8. The cleaning apparatus according to claim 1, further comprising:

an image bearing body contacting a blade member, the blade member configured to clean the image bearing body.

9. The cleaning apparatus according to claim 1, further comprising:

a transfer device adapted to transfer an image to a recording sheet.

10. An image forming apparatus, comprising:

a cleaning apparatus comprising:

a brush member configured to contact and to remove negatively charged toner particles from a charging roller that is electrically charged, wherein the brush member comprises a conductive material and a fiber material that is positively chargeable when rubbed with the toner particles, wherein the brush member is configured to be driven to rotate by rotation of the charging roller, and wherein the brush member has a resistance value between $1\times10^3$ Ω and $1\times10^8$ Ω.

11. The image forming apparatus according to claim 10, wherein the brush member is configured to be held by its own weight in contact with the charging roller.

12. The image forming apparatus according to claim 10, wherein a length of the brush member is not greater than 2 mm.

13. The image forming apparatus according to claim 10, wherein the brush member comprises a plurality of bristles including the conductive material, wherein the bristles have a thickness of not greater than 5 deniers, and wherein a density of the bristles is at least 15000 bristles/cm$^2$.

14. The image forming apparatus according to claim 10, wherein the brush member comprises a brush roller.

15. The image forming apparatus according to claim 10, wherein the conductive material comprises carbon.

16. The image forming apparatus according to claim 10, further comprising:

an image bearing body configured to bear an image, the image bearing body contacting a blade member, the blade member configured to clean the image bearing body, wherein the charging roller comprises a charging device configured to charge the image bearing body.

17. The image forming apparatus according to claim 13, further comprising:

an image bearing body configured to bear an image, wherein the charging roller comprises a charging device configured to charge the image bearing body, the charging device contacting the brush member, the brush member configured to clean the charging device.

18. The image forming apparatus according to claim 10, further comprising:

an image bearing body configured to bear an image; and a transfer device configured to transfer the image from the image bearing body to a recording medium, wherein the charging roller comprises a charging device configured to charge the image bearing body.

19. The image forming apparatus according to claim 10, wherein the brush member is configured to remove toner particles prepared by a polymerization method.

20. The image forming apparatus according to claim 10, further comprising:

a removable process cartridge comprising the cleaning apparatus.

21. An image forming apparatus, comprising:

a charging roller that is electrically charged; and a cleaning apparatus comprising:

means for removing negatively charged toner particles attached to the member by electrostatic charge, the means for removing contacting the member, wherein the means for removing comprises a conductive material and a fiber material that is positively chargeable when rubbed with the toner particles and is configured to rotate by rotation of the charging roller, and wherein the means for removing has a resistance value between $1\times10^3$ Ω and $1\times10^8$ Ω.

22. The image forming apparatus according to claim 21, further comprising:

means for bearing an image.

23. The image forming apparatus according to claim 21, wherein the charging roller comprises means for charging an image bearing body.

24. The image forming apparatus according to claim 21, further comprising:

means for transferring an image from an image bearing body to a recording medium.

25. A method of cleaning negatively charged toner particles from a charging roller that is electrically charged, comprising:

contacting a brush to the member; and rotating the brush via rotation of the charging roller, wherein the brush comprises a conductive material and a fiber material that is positively chargeable when rubbed with the toner particles, and wherein the brush has a resistance value between $1\times10^3$ Ω and $1\times10^8$ Ω.

26. The method according to claim 25, wherein the brush comprises a plurality of bristles.

27. The method according to claim 26, wherein the brush comprises a brush roller.

* * * * *